US008795439B2

(12) United States Patent
Vernon et al.

(10) Patent No.: US 8,795,439 B2
(45) Date of Patent: Aug. 5, 2014

(54) METHOD AND APPARATUS FOR WASHING TEMPORARY ROAD MATS

(75) Inventors: Craig D. Vernon, Ashland, WI (US); Dan Petras, Ashland, WI (US)

(73) Assignee: Beasley IP Holdings, LLC, Hazelhurst, GA (US)

( * ) Notice: Subject to any disclaimer, the term of this patent is extended or adjusted under 35 U.S.C. 154(b) by 1061 days.

(21) Appl. No.: 12/506,879

(22) Filed: Jul. 21, 2009

(65) Prior Publication Data

US 2011/0017245 A1 Jan. 27, 2011

(51) Int. Cl.
*B08B 1/02* (2006.01)
*B08B 3/00* (2006.01)

(52) U.S. Cl.
USPC ..... 134/122 R; 198/860.4; 15/77; 15/93.4

(58) Field of Classification Search
CPC ..... B08B 3/041; B08B 1/005; B08B 1/02; B65G 15/46
USPC ..... 134/122 R, 123–131; 15/77, 93.4; 193/35 G; 198/451–452, 459.7
See application file for complete search history.

(56) References Cited

U.S. PATENT DOCUMENTS

| | | | | |
|---|---|---|---|---|
| 880,713 | A | | 3/1908 | Blair |
| 1,267,304 | A | * | 5/1918 | Adams ..... 15/230.16 |
| 1,617,833 | A | | 2/1927 | Armstrong |
| 1,714,075 | A | | 5/1929 | Carvalho |
| 2,229,605 | A | | 1/1941 | Snyder et al. |
| 2,592,857 | A | | 4/1952 | Chadwick |
| 2,651,065 | A | | 9/1953 | O'Connor |
| 2,698,627 | A | | 1/1955 | Kearney et al. |
| 2,701,378 | A | * | 2/1955 | Dugan et al. ..... 15/111 |
| 2,714,892 | A | | 8/1955 | Mendenhall et al. |
| 3,090,392 | A | | 5/1963 | Libby |
| 3,098,250 | A | | 7/1963 | Creech |
| 3,144,872 | A | | 8/1964 | Kearney |
| 3,178,745 | A | * | 4/1965 | Kleebauer ..... 15/77 |
| 3,179,117 | A | | 4/1965 | Gibson et al. |
| 3,289,238 | A | | 12/1966 | Sorenson et al. |
| 3,409,030 | A | | 11/1968 | Schmidt |
| 3,416,545 | A | | 12/1968 | Holzemer |
| 3,421,526 | A | | 1/1969 | Alkire et al. |
| 3,656,493 | A | * | 4/1972 | Black et al. ..... 134/113 |
| 3,675,665 | A | | 7/1972 | Sadwith |
| 3,694,847 | A | | 10/1972 | Hetman et al. |
| 3,747,151 | A | | 7/1973 | Takeuchi |
| 3,772,732 | A | * | 11/1973 | Gilmore ..... 15/309 |
| 3,849,820 | A | | 11/1974 | Lang |
| 3,990,571 | A | | 11/1976 | Kitterman et al. |
| 4,104,755 | A | * | 8/1978 | Smith ..... 15/40 |
| 4,281,675 | A | | 8/1981 | Pure |
| 4,367,798 | A | * | 1/1983 | Sabol ..... 168/45 |
| 4,670,932 | A | * | 6/1987 | Williams ..... 15/237 |
| 4,747,175 | A | * | 5/1988 | Durgin ..... 15/105 |
| 4,805,649 | A | | 2/1989 | Nezworski |

(Continued)

*Primary Examiner* — Joseph L Perrin
*Assistant Examiner* — Kevin G Lee
(74) *Attorney, Agent, or Firm* — Thomas Horstemeyer LLP

(57) ABSTRACT

An apparatus for cleaning contaminants from a construction mat is described including a washing chamber and an automated conveyor assembly translating the construction mat into and out of the washing chamber. The washing chamber includes a plurality of elongated tines adapted to scrape debris from the was mat and a spray system direction cleansing liquid under pressure at the mat, and a closed loop water reclamation system for filtering and recycling cleansing liquid for reusing the spray system.

20 Claims, 6 Drawing Sheets

(56) References Cited

U.S. PATENT DOCUMENTS

| | | | | | |
|---|---|---|---|---|---|
| 4,807,319 | A | | 2/1989 | Poitevin | |
| 4,845,797 | A | * | 7/1989 | Kobayashi | 15/41.1 |
| 4,971,084 | A | | 11/1990 | Smith et al. | |
| 5,013,367 | A | * | 5/1991 | Butts | 134/9 |
| 5,052,332 | A | | 10/1991 | Hajek et al. | |
| 5,231,726 | A | | 8/1993 | McKenney et al. | |
| 5,316,408 | A | | 5/1994 | Stanley et al. | |
| 5,372,153 | A | | 12/1994 | Dobson | |
| 5,419,349 | A | | 5/1995 | Swain | |
| 5,446,942 | A | | 9/1995 | Whitehorn | |
| 5,584,656 | A | * | 12/1996 | Rose | 416/132 A |
| 5,694,660 | A | * | 12/1997 | Rachwalski | 15/237 |
| 6,129,099 | A | * | 10/2000 | Foster et al. | 134/57 R |
| 6,315,056 | B1 | * | 11/2001 | Ransom et al. | 172/684.5 |
| 6,578,714 | B2 | | 6/2003 | Rohrbacher et al. | |
| 7,287,535 | B2 | | 10/2007 | Kataoka | |
| 7,302,894 | B2 | * | 12/2007 | Belanger et al. | 104/242 |
| 7,641,851 | B2 | * | 1/2010 | Williams et al. | 422/22 |
| 2004/0031507 | A1 | * | 2/2004 | Ross et al. | 134/123 |

* cited by examiner

METHOD AND APPARATUS FOR WASHING TEMPORARY ROAD MATS

I. BACKGROUND OF THE INVENTION

This invention relates to an apparatus for washing and cleaning dragline mats. More particularly, the invention relates to an automated self-contained, mobile washing apparatus for dragline mats having scraping members and a washing chamber.

II. DESCRIPTION OF THE PRIOR ART

Construction workers, maintenance workers or drilling workers typically need to move trucks and heavy equipment to worksites. These worksites frequently have wet ground and a sensitive natural environment. The transportation of such trucks and heavy equipment can damage the ecosystem of the worksite.

Dragline mats (or construction mats) are used to better protect the ecosystem of worksites. Dragline mats are large dimensional mats made from hardwood. Such mats eliminate the need to construct gravel roads and platforms for transporting trucks and heavy equipment to worksites. Instead, the mats provide a solid road surface for the equipment and trucks. Each dragline mat is a discreet unit which, when laid end-to-end with other dragline mats, can form a temporary road. An additional benefit of dragline mats is that they can be lifted and transported out of the area and reused at other worksites.

As mentioned above, dragline mats are commonly made from hardwood. When hardwood dragline mats are placed in muddy or boggy areas, they may collect "invasive species". Invasive species are any non-indigenous species that adversely affect the habitats of ecosystems to which they are transplanted. Anthropogenic pathways for invasive species are often unintentional and can occur when soil is transplanted from one site to another. Invasive species can have economical, environmental and ecological negative impacts.

Governments typically regulate worksites to protect ecosystems from anthropogenic damage. Some such regulations require the use of dragline mats in wetland areas for transporting heavy machinery. Other regulations require that all machinery and equipment used on a worksite be cleaned for invasive species. These regulations require that dragline mats be cleaned thoroughly before being transported or reused.

A need therefore exists for a method and apparatus for cleaning an invasive species off of dragline mats, which does not allow the invasive species to contaminate surrounding soil at the clean-up site. Presently, the only apparatus commonly used to wash invasive species from a dragline mat is a high-pressure hose. The problem with such a hose is that it is neither thorough, nor self-contained. Water will wash away back into the soil, possibly contaminating the soil where the mat is being washed with invasive species.

SUMMARY OF THE INVENTION

The present invention has the object of providing a method and apparatus for cleaning an invasive species from a dragline mat incorporating a water reclamation system to prevent contamination of the soil.

Another object of the invention is to provide an apparatus which more thoroughly cleans invasive species off of a dragline mat.

A further object of the invention is to provide an apparatus for cleaning invasive species off of a dragline mat that is mobile and capable of being transported to a worksite on the back of a flatbed trailer.

These and other objects and advantages of the invention are achieved by providing an automated, self-contained washing apparatus for cleaning dragline mats in accordance with the preferred embodiment of the present invention. The apparatus of the present invention provides a washing chamber formed by an outside shell in which is contained an assembly having a pair of vertically extending rotatable brushes, a high-pressure washing system and a closed-loop water reclamation system. A vehicle mounted conveyor system feeds the dragline mats into and through the washing chamber after such articles are loaded onto the conveyor system. As the dragline mats are moved into the washing chamber, a plurality of horizontally disposed tines scrape debris off the opposed major surfaces of the dragline mats. Once inside the washing chamber, a high-pressure washing system further blasts mud and debris from the dragline mats. The vertically extending rotatable brushes engage the opposed sides of the mats to loosen caked-on debris away from the dragline mats.

The washing system includes a spray arm with a plurality of longitudinally spaced nozzles wherein said nozzles provide sufficient pressure to effectively clean the dragline mat, including crevices, grooves and pockets in the hardwood of the dragline mat. The washing system sprays a wash fluid adapted and suitable for cleaning the soil with invasive species off of the dragline mat.

The conveyor system includes a pair of mutually cooperating guide rails and a guard rail assembly which ensures that the dragline mats disposed on edge do not fall off the cleaning apparatus before or after washing and thereby preventing injury. The conveyor system has a hydraulically controlled roller assembly having a first and second end. The dragline mats are placed on the roller assembly on their edge dimension. A pair of guide rails runs along the length perimeter of the roller assembly from the first end to the washing chamber. The conveyor also has a guard rail extending upward from the guide rails to prevent the dragline mat from tipping off the roller assembly as it is carried toward the washing chamber.

The closed-loop water reclamation system filters and reuses cleansing liquid while conserving water used and consumed in the operation of the present invention. More importantly, the closed-loop reclamation system ensures that cleansing liquid contaminated in the washing operation of the present invention does not pollute job sites with species from other job sites. The reclamation system includes a holding tank filled with cleansing liquid. The holding tank supplies the cleansing liquid to the spray system via a high-pressure pump. After the cleansing spray carries the soil away it flows underneath the conveyor system and is suctioned out by a second high-pressure pump. The now-contaminated cleansing liquid is strained and filtered through at least one cartridge adapted to filter out the contaminated soil from the cleansing liquid. The filtered cleansing liquid is then pumped back into the holding tank for reuse.

BRIEF DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DETAILED DESCRIPTION OF THE PREFERRED EMBODIMENT

Figure 1:
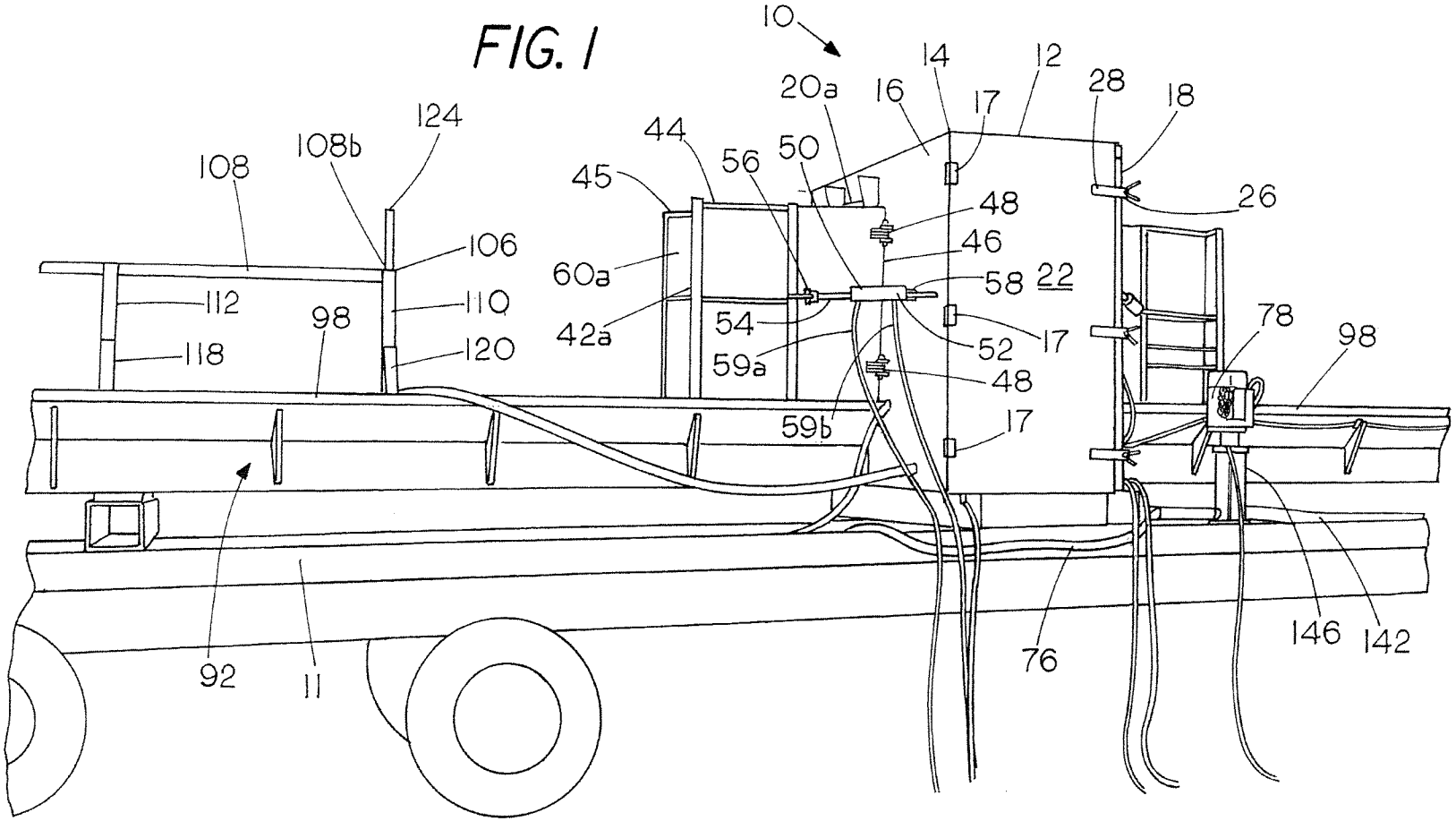
FIG. 1 is a front perspective view of the apparatus for washing temporary road mats of the present invention.

The description of the preferred embodiment is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly" etc.) should be construed to refer to the orientation as then described or as shown in the drawings under discussion. These relative terms are for convenience of description and do not require that the apparatus be constructed or operated in a particular orientation. Terms, such as "connected", "connecting", "attached", "attaching", "join" and "joining" are used interchangeably and refer to one structure or surface being secured to another structure or surface or integrally fabricated in one piece unless expressly described otherwise.

Figure 2:
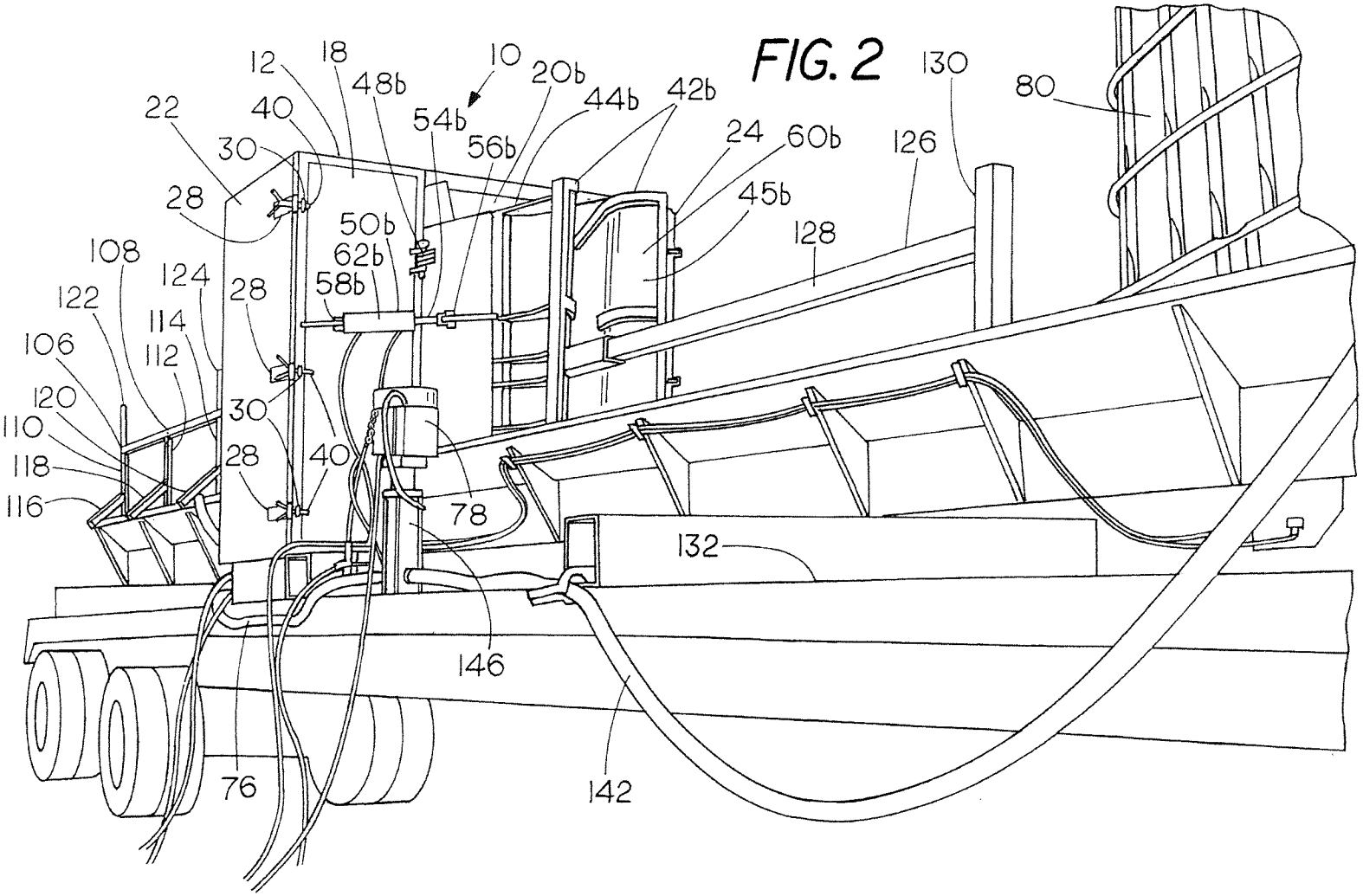
FIG. 2 is a rear perspective view of the apparatus.

Referring to the drawings, the present invention is shown as embodied in a mobile, automated washing apparatus 10 for cleaning mud-caked dragline mats. As shown in FIG. 1, the apparatus 10 includes a truck or trailer wheel-mounted frame 11 supporting a washing chamber 12 having an outer shell assembly 14. The outer shell assembly 14 includes vertically extending front wall 16 and a back wall 18. The front wall 16 includes an entrance opening 20*a*, and back wall 18 has exit opening 20*b* (FIG. 2). The openings 20*a* and 20*b* are sized to allow a dragline mat, on edge, to enter and exit the washing chamber 12. The washing chamber also includes a first side wall 22 and a second side wall 24. The first side wall 22 is hingedly connected to the front wall 16 by hinges 17 wherein the first side wall 22 is locked in place by a plurality of locking mechanisms 26.

As shown in FIG. 2, the locking mechanisms include first and second bracket members 28 and 30, wherein the first bracket member 28 projects from the periphery of the first side wall 22 and the second bracket member 30 projects from the back wall 18. Each bracket member 28 and 30 has an aperture that aligns when the front wall 16 is in a closed position, and a bolt 40 passes through the apertures and secures the bracket members in a locked position. Likewise, the second side wall 24 is hingedly connected to the front wall 16 and has a plurality of locking mechanisms 26 previously described.

The washing chamber 12 also includes double hydraulic doors 42*a* connected by hinges to the front wall 16 and adapted to cover the entrance opening 20*a* when closed. The hydraulic doors 42*a* include two substantially identical doors 44 and 45 with rounded end panels 60*a*, wherein one door 44 is hingedly mounted at each side of the opening 20*a* by door hinge 48 for movement between an open position and a closed position. The hydraulic doors 42*a* further include a hydraulic door actuator 50 operatively associated with at least one of the doors 44 and 45 for coordinating the opening and closing of the doors relative to the mat receiving opening 20*a*. The hydraulic door actuator 50 facilitates reciprocal movement of the doors 44 and 45. The hydraulic door actuator 50 includes a cylinder 52 with a piston 54 therein. The piston 54 is in driving connection with a door clevis bracket 56 affixed to the door 44. The piston 54 is extendable and retractable relative to the cylinder 52. The cylinder 52 is pivotally coupled at its end to a clevis bracket 58 affixed to the front wall 16. A hydraulic circuit controls the positioning of the actuator 50 via hydraulic lines 59*a* and 59*b*.

The washing chamber further includes a second set of double hydraulic doors 42*b* hingedly connected to the back wall 18 to cover the exit opening 20*b* of the washing chamber. The second hydraulic doors 42*b* include identical doors 44*b* and 45*b* with rounded end panels 60*b*. Door 44*b* is connected by hinges 48*b* mounted to each side of exit opening 20*b* for movement between an opened and closed position. Second hydraulic doors 42*b* (FIG. 2) include their own hydraulic door actuator 50*b* shown operatively coupled to door 44*b* for coordinating the opening and closing of the double doors 42*b*. Actuator 50*b* includes cylinder 52*b* and piston 54*b* therein. The piston 54*b* is in driving connection with an exit door bracket 56*b* affixed to door 44*b*. The piston 54*b* is contained in cylinder 52*b*. The cylinder 52*b* is coupled at one end to back wall 18 by back wall bracket 58*b*.

Figure 3:
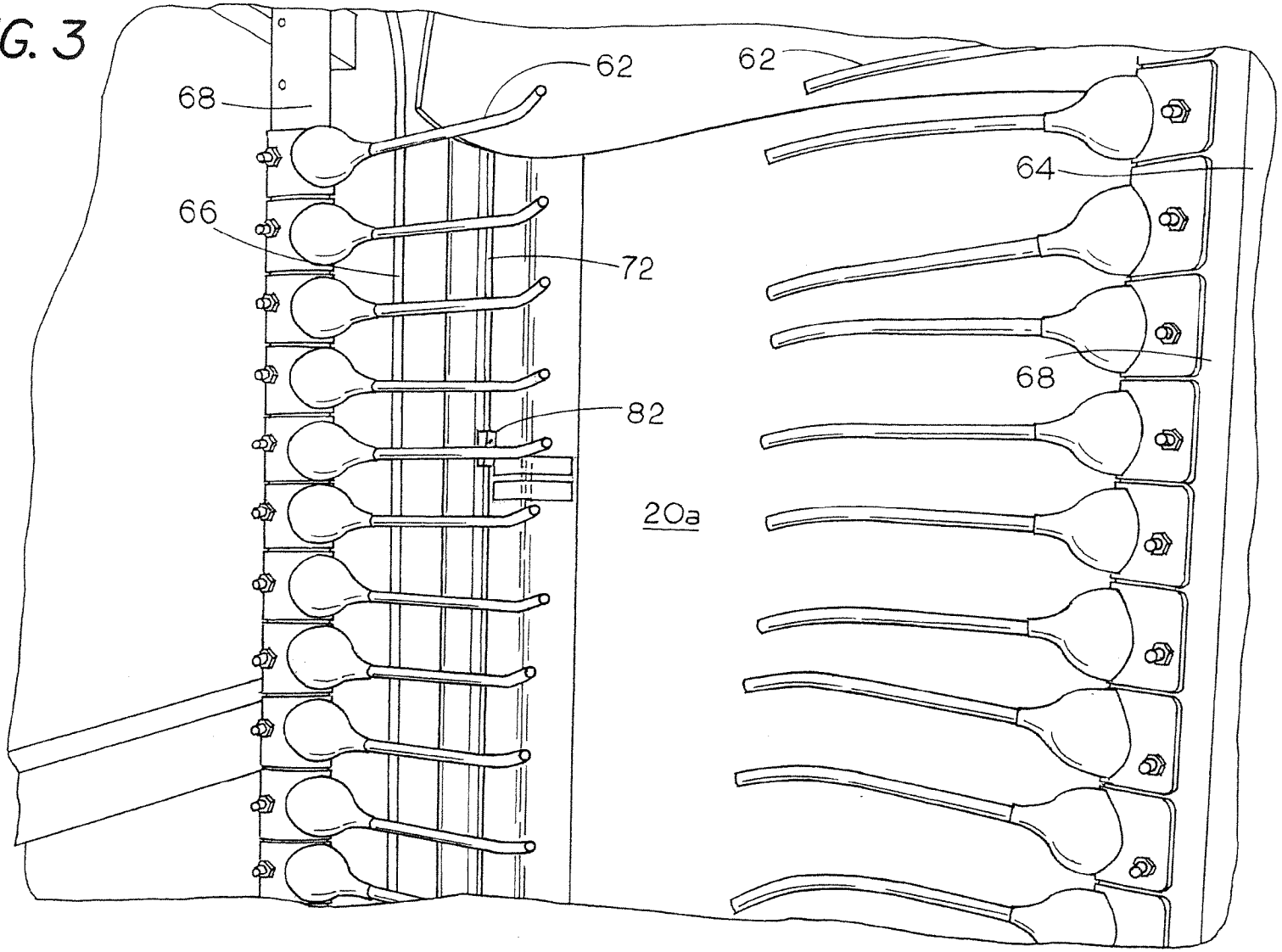
FIG. 3 is a first view of the plurality of tines of the entrance opening of the present invention.

Turning to FIG. 3, the washing chamber 12 includes a plurality of elongated horizontally extending tines 62 adapted to be positioned in longitudinally spaced-apart relation along each length dimension 64, 66 of opening 20*a*. They are positioned so as to push sidewardly on a dragline mat passing through the chamber 12 to scrape debris from the opposed major surfaces of the dragline mat. The tines 62 extend from a bar 68 running along the length dimensions 64, 66 of opening 20.

The washing chamber 12 further includes a high-pressure spray system for washing away the remaining debris from the opposed major surfaces of the dragline mat. The dragline mat is subjected to sprays of cleansing liquid from wash manifolds 72 on the left and right sides of the opening 20*a*. The left and right wash manifolds 72 are supplied with cleansing liquid through supply conduit 76 (FIG. 1) by a high-pressure pump 78 which draws from holding tank 80 (FIG. 2). The left and right wash manifolds 72 include a number of spray nozzles 82 for forming pressurized streams. In the preferred embodiment there are eleven such nozzles 82 on each of the manifolds 72. The left manifold 72 is positioned to the left side of the washing chamber 12 relative to opening 20 when viewed in FIG. 3, and the right manifold (not shown) is positioned to the right side of the washing chamber 12 relative to opening 20. The nozzles 82 are positioned to face one another, such that as the dragline mat is carried through the washing chamber 12 past the tines 62 it is sprayed with the washing fluid on its opposed major surfaces by the nozzles 82.

The washing chamber 12 also includes a closed-loop water reclamation system for filtering and reusing the cleansing liquid. Because the apparatus 10 is transported to a worksite on the back of a flatbed truck or trailer, the washing chamber will need its own supply of cleansing fluid (such as water mixed with soap or some other cleansing solution). Furthermore, because the reclamation system is closed-loop, it prevents the cleansing liquid from contaminating the worksite with the invasive species. The reclamation system includes the previously mentioned holding tank 80 filled with cleansing liquid. A hose 142 (FIG. 2) runs from the holding tank 80 to the high-pressure pump 78. The high-pressure pump 78 is driven by a hydraulic motor and pumps the cleansing liquid to the spray system 70 in the washing chamber 12, via supply conduit 76, which runs from the pump 78 to the washing chamber 12. Pump 78 also is connected in line to a filter assembly 142. After the cleansing spray carries the soil away, it drains underneath an endless conveyor belt 96 (FIG. 4) of a conveyor assembly. The now-contaminated liquid is pumped back to the filter assembly 142 by the drainage pump 144 (FIG. 6) where it is strained and filtered to remove the solid contaminants from the cleansing liquid. The filtered cleansing liquid is pumped back into the holding tank 80.

Figure 6:
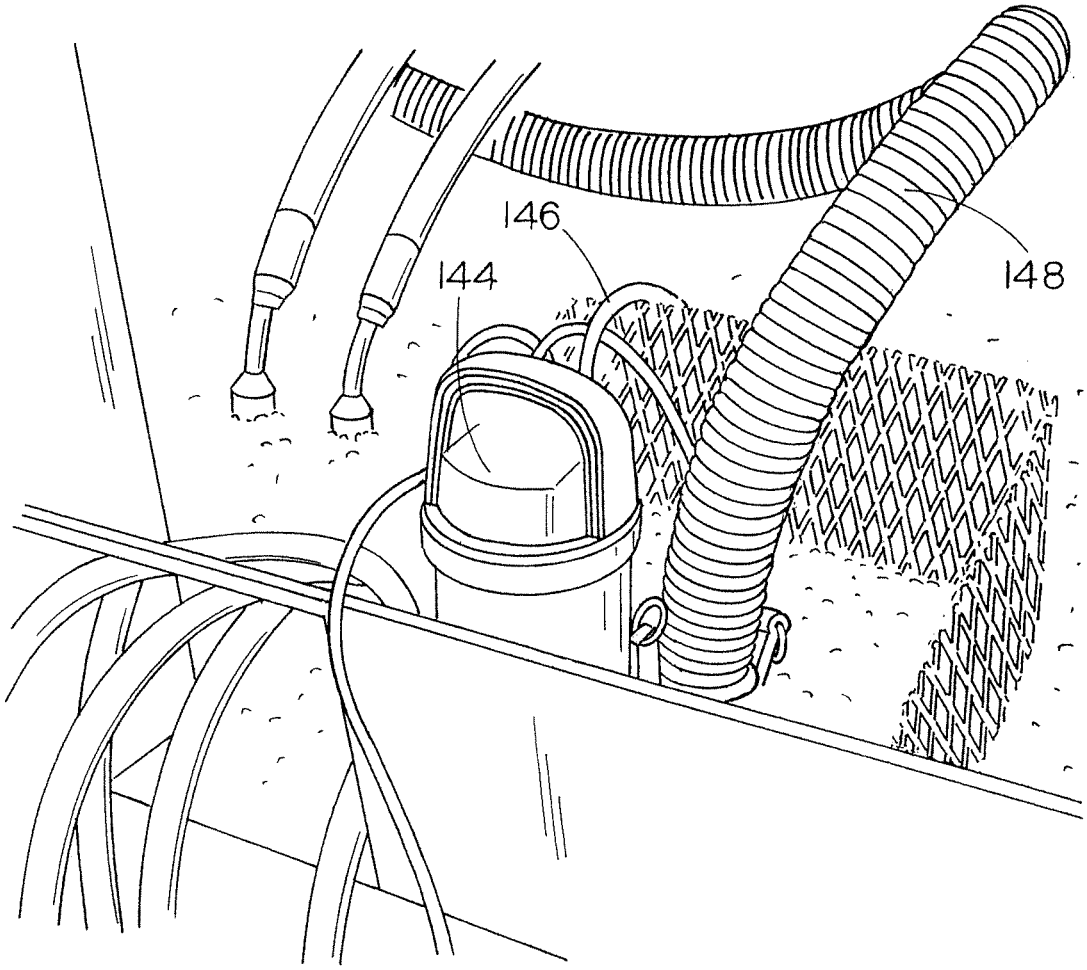
FIG. 6 is a perspective view of the washing chamber.

FIG. 6 shows the drainage pump 144. The drainage pump 144 is located in the interior of the washing chamber 12. The drainage pump 144 includes a drainage conduit 146 which reaches under the endless drive belt 96 to intake the contaminated liquid and is pumped back to the filter assembly 142 by the drainage pump 144. The contaminated liquid travels from the drainage pump 144 to the filter assembly 142 via hose 148.

Figure 4:
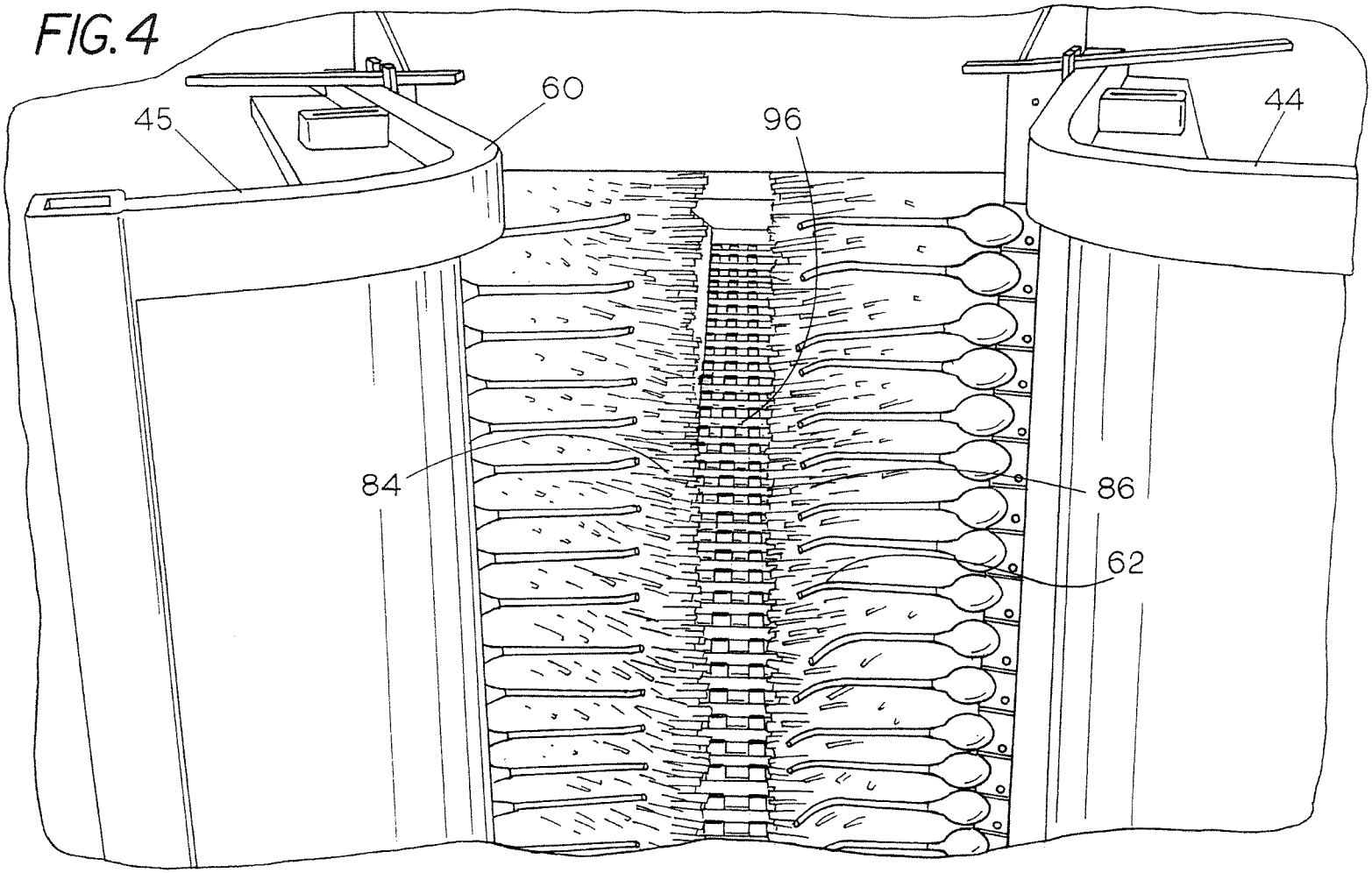
FIG. 4 is a second view of the entrance opening of the washing chamber.

As shown in FIG. 4, the washing chamber 12 also includes left and right rotatable vertical brushes 84 and 86 mounted on a frame assembly inside the washing chamber 12. The cylindrical brushes have a height dimension equal to or greater than the height of a mat when on edge. The frame assembly is mounted to a top wall of the washing chamber 12, wherein the top wall is connected to the front wall 16, back wall 18 and first and second side walls 22 and 24 to close the outer shell 14. The vertical brushes 84 and 86 depend from the frame assembly through the shaft which is driven by a hydraulic motor. Rotation of the vertical brushes 84 and 86 brush the major surfaces of the dragline mat as they are carried by the conveyor assembly through the cleaning chamber 12.

The present invention 10 also includes a conveyor assembly indicated generally by numeral 92 in FIG. 1 for translating the dragline mat, on edge, through the washing chamber 12. The conveyor assembly includes a plurality of sprockets (not shown) keyed to a plurality of transverse shafts (not shown), wherein at least one of the sprockets is driven by a suitable power means used conventionally to rotate a belt. An endless drive belt 96 (FIG. 5) is driven around the sprockets.

Figure 5:
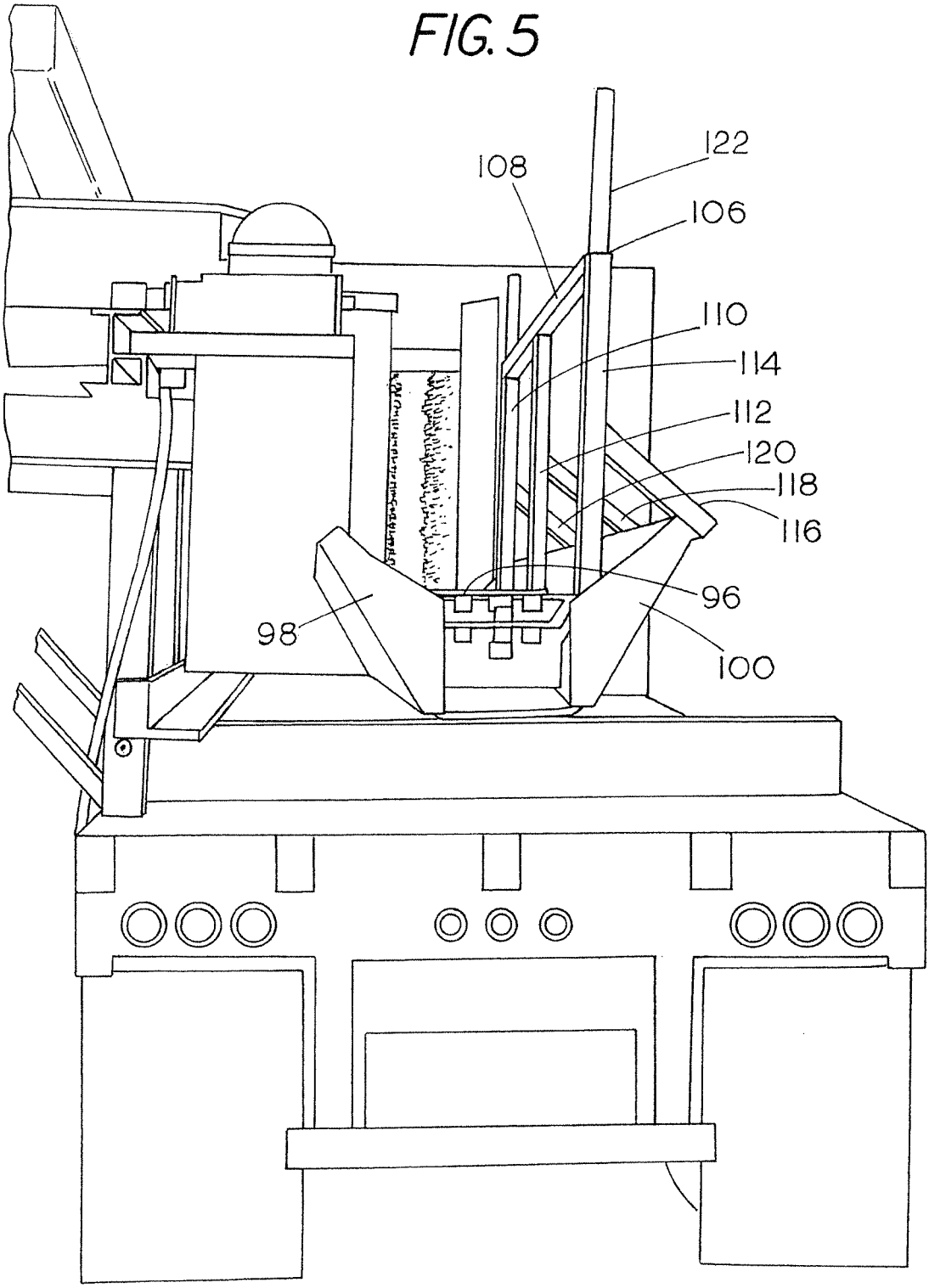
FIG. 5 is a rear view of the trailer mounted mat cleaning assembly.

FIG. 5 illustrates a segment of the conveyor assembly.

The conveyor assembly also includes first and second guide rails 98 and 100 running along the length of the drive belt 96, interrupted by the washing chamber 12. To keep the dragline mat in an upright position a guard rail 106 extends up from the first guide rail 100. The guard rail 106 includes a horizontal rail 108 extending a predetermined length along the length of the first guide rail 98. The rail member 108 is supported by three post members 110, 112 and 114 depending from the top member and 108 joined to the second side 104 of the second guide rail proximate the connection to its first side 102. Each post member 110, 112 and 114 has a brace 116, 118 and 120 extending from the post member to the second guide rail 100. For additional support, the guard rail 106 includes extensions 122 and 124 extending upward from the top member 108 at its first end 108*a* and second end 108*b*. Thus, when the dragline mat is placed on-edge on the drive belt 96, the guard rail assembly 106 just described ensures that the dragline mat does not fall off the conveyor assembly 92 before the mat reaches the washing chamber 12.

The exit side of the washing chamber 12 includes the drive belt 96 carrying the dragline mat out of the washing chamber 12. Guide rails 98 and 100 run along the drive belt 96 to guide the dragline mat. A second guard rail 126 prevents the dragline mat from falling off the conveyor assembly 92. The second guard rail 126 includes a horizontal work piece 128 running between the one door 44*b* and a vertical work piece 130.

The process for washing a dragline mat is as follows. The washing apparatus 10 of the present invention is placed on the back 132 of a flat bed truck. Next, a dragline mat is placed on the drive belt 96 along its lengthwise dimension. The drive belt 96 carries the dragline mat along the conveyor assembly while the guide rails 98 and 100 guide the mat along the length of the drive belt 96. The guard rail 106 is mounted on the guide rail 100 opposite where the dragline mat is loaded onto the conveyor assembly to prevent the dragline mat from falling off the conveyor assembly. As the drive belt 96 carries the dragline mat toward the washing chamber 12, the hydraulic doors 42 are positioned to guide the dragline mat into the washing chamber 12.

The drive belt 96 then carries the dragline mat into the washing chamber 12 such that the plurality of elongated horizontally extending tines 62 mounted on the bars 68 rub sidewardly on the opposed major surfaces of the dragline mat. The tines 62 therefore scrape a substantial amount of debris from the top and bottom surfaces from the dragline mat.

The drive belt 96 next carries the dragline mat past the tines 62 and toward the high-pressure nozzles of the spray system 70 to wash remaining debris from the top and bottom surface. Spray nozzles 82 spray cleansing liquid in pressurized streams on the top and bottom surface of the dragline mat to blast the debris off of the mat.

The drive belt 96 then carries the dragline mat away from the spray system 70 toward the left and right vertical brushes 84 and 86. The vertical brushes 84 and 86 are conventional vertical brushes that are typically found in carwashes. The vertical brushes 84 and 86 rotate and scrape the dragline mat. The scraping of the brushes both dries the dragline mat and removes any remaining debris from the mat not removed by the horizontal elongated tines 62 or the spray system 70.

The drive belt 96 then carries the dragline mat out of the washing chamber 12 through opening 20 on back wall 18. The guide rails 98 and 100 run along drive belt 96 to guide the dragline mat. The second guide rail 126 prevents the dragline mat from falling off the drive belt 92.

Used cleansing liquid is salvaged by the water reclamation system. The liquid drains underneath the endless conveyor belt 96 and is pumped back to the filter assembly 142 where it is strained and filtered to remove the solid contaminants from the cleansing liquid. The high-pressure pump pumps the filtered cleansing liquid back to the holding tank 80 for reuse.

What is claimed is:

1. An apparatus for cleaning contaminants from a construction mat comprising:

an outside shell defining a washing chamber with an entrance and an exit;

an automated conveyor assembly for translating the construction mat through the entrance and out the exit of the washing chamber;

a plurality of elongated horizontally extending rigid tines vertically spaced apart from one another procreate the entrance and adapted to engage and scrape opposed major side surfaces of the construction mat;

a first hydraulically operated door assembly connected to the washing chamber at an entrance opening, wherein the first hydraulically operated door assembly comprises a first pair of hydraulic non-planar doors having rounded end panels that are adapted to cover the entrance opening when closed and to guide the construction mat into the washing chamber when opened, wherein an interior surface of each non-planar door of the first pair comprises a convex-shape that faces the interior surface of an opposing non-planar door of the first pair when closed;

a second hydraulically operated door assembly connected to the washing chamber at an exit opening, wherein the second hydraulically operated door assembly comprises a second pair of hydraulic non-planar doors having rounded end panels that are adapted to cover the exit opening when closed and to guide the construction mat away from the washing chamber when opened, wherein an interior surface of each non-planar door of the second pair comprises a convex-shape that faces the interior surface of an opposing non-planar door of the second pair when closed;

a liquid spray system in the washing chamber for removing contaminants from the construction mat, the spray system directing cleansing liquid under pressure at the construction mat when the construction mat is traversing the washing chamber on the conveyor assembly, the spray system including:

first and second manifolds positioned on opposite sides of the entrance of the washing chamber, the manifolds having a plurality of nozzles forming pressurized streams; and a closed loop liquid reclamation assembly including:

a holding tank at a base of the washing chamber for holding a quantity of cleansing liquid;

a first high-pressure pump supplying cleansing liquid to the first and second manifolds of the liquid spray system under high pressure; and a second high-pressure pump for moving the sprayed liquid through a filter means in the loop for removing particulate material from the liquid before it is returned to the holding tank.

2. The apparatus of claim 1, further including a pair of brushes rotatable about a vertical axis and mounted on a frame assembly disposed in the washing chamber for scraping additional contaminants from the mat, the frame assembly being mounted to a top wall of the washing chamber.

3. The apparatus of claim 1, wherein the conveyor assembly includes an endless drive belt running through the washing chamber, a pair of guide rails aligned with each side edge of the drive belt to maintain the construction mat in an upright orientation as the mat is moved by the conveyor assembly, and a guard rail mounted on either side of the washing chamber to prevent the construction mat from falling off the drive belt when not inside the washing chamber.

4. The apparatus of claim 1 wherein the washing chamber, conveyor and assembly are vehicle mounted.

5. The apparatus of claim 1, wherein the first pair of hydraulic non-planar doors is hingedly mounted at each side of the entrance opening.

6. The apparatus of claim 1, wherein the second pair of hydraulic non-planar doors is hingedly mounted at each side of the exit opening.

7. The apparatus of claim 1, wherein the automated conveyor assembly acts to carry the construction mat through the washing chamber past the rigid tines as the construction mat is sprayed with cleansing liquid on its opposed major surfaces by the nozzles of the liquid spray system.

8. The apparatus of claim 2, wherein the automated conveyor assembly acts to carry the construction mat through the washing chamber past the rigid tines as the construction mat is sprayed with cleansing liquid on its opposed major surfaces by the nozzles of the liquid spray system, wherein the automated conveyor assembly further acts to carry the construction mat past the nozzles and towards the pair of brushes for scraping contaminants from the construction mat before exiting the washing chamber.

9. An apparatus for cleansing contaminants off of a construction mat comprising:

a washing chamber having an entrance and an exit opening and further including a first hydraulically operated door assembly connected to the washing chamber at the entrance opening, wherein the first hydraulically operated door assembly comprises a first pair of hydraulic non-planar doors having rounded end panels that are adapted to cover the entrance opening when closed and to guide the construction mat into the washing chamber when opened, wherein an interior surface of each non-planar door of the first pair comprises a convex-shape that faces the interior surface of an opposing non-planar door of the first pair when closed;

an automated conveyor assembly for translating the construction mat into and out of the washing chamber;

a second hydraulically operated door assembly connected to the washing chamber at the exit opening, wherein the second hydraulically operated door assembly comprises a second pair of hydraulic non-planar doors having rounded end panels that are adapted to cover the exit opening when closed and to guide the construction mat away from the washing chamber when opened, wherein an interior surface of each non-planar door of the first pair comprises a convex-shape that faces the interior surface of an opposing non-planar door of the second pair when closed;

a plurality of elongated, horizontally extending rigid spaced-apart tines vertically oriented proximate the entrance opening adapted to scrape either side of the construction mat upon passage through the entrance opening of the washing chamber;

a spray system to wash away contaminants from the construction mat, the spray system directing cleansing liquid in high-pressure streams at the construction mat while the construction mat is inside the washing chamber;

a holding tank for holding a quantity of cleansing liquid;

a first high-pressure pump for supplying cleansing liquid from the holding tank to the spray system under high pressure;

a drainage conduit disposed under the conveyor assembly and inside the washing chamber whereby used cleansing liquid drains from the washing chamber into the drainage conduit;

a pump and filtering assembly coupled in line with the drainage conduit for filtering and removing contaminants from the used cleansing liquid and moving the filtered cleansing liquid into the holding tank, the filter and pump forming a closed-loop liquid reclamation system.

10. The apparatus of claim 9, and further including a frame assembly disposed in the washing chamber and affixed to a top wall of the washing chamber and a pair of brushes journaled on the frame and rotatable about axes for removing additional contaminants from opposite side surfaces of the mat after the mat is subjected to the spray system, the pair of brushes being mounted on the frame assembly.

11. The apparatus of claim 10, wherein the first pair of hydraulic non-planar doors includes first and second doors wherein the first door is mounted to a first side of the entrance opening, and a second door is mounted to the second side of the entrance opening, and a hydraulic door activator operatively associated with one of the first and second doors for coordinating reciprocal opening and closing of the first and second doors.

12. The apparatus of claim 9, wherein the conveyor assembly includes an endless drive belt running through the washing chamber, with guide rails lining each side of the drive belt to maintain the construction mat in an upright on-edge orientation as the mat moves with the drive belt, and a guard rail mounted on either side of the washing chamber to prevent the construction mat from falling off the drive belt when not supported by the washing chamber.

13. The apparatus of claim 12, wherein the conveyor assembly further includes a plurality of sprockets keyed to a plurality of rotatable transverse shafts wherein at least one of the sprockets is driven by a power means and the drive belt is deployed around the sprockets.

14. The apparatus of claim 9, wherein the spray system includes first and second manifolds positioned on opposing sides of the entrance to the washing chamber, the manifolds having a plurality of nozzles for forming pressurized streams of cleansing liquid.

15. The apparatus of claim 4 wherein the filter assembly further includes:

a conduit for supplying the used cleansing liquid from the second high-pressure pump to the filter assembly; and at least one filter disposed in line with the conduit.

16. The apparatus of claim 9 wherein the washing chamber and conveyor assembly are vehicle mounted.

17. The apparatus of claim 9, wherein the first pair of hydraulic non-planar doors is hingedly mounted at each sides of the entrance opening.

18. The apparatus of claim 9, wherein the second pair of hydraulic non-planar doors is hingedly mounted at each side of the exit opening.

19. The apparatus of claim 9, wherein the automated conveyor assembly acts to carry the construction mat through the washing chamber past the rigid tines as the construction mat is sprayed with cleansing liquid on its opposed major surfaces by the spray system.

20. The apparatus of claim 10, wherein the automated conveyor assembly acts to carry the construction mat through the washing chamber past the rigid tines as the construction mat is sprayed with cleansing liquid on its opposed major surfaces by the spray system, wherein the automated conveyor assembly further acts to carry the construction mat past the spray systems and towards the pair of brushes for scraping contaminants from the construction mat before exiting the washing chamber.

* * * * *

UNITED STATES PATENT AND TRADEMARK OFFICE

CERTIFICATE OF CORRECTION

PATENT NO. : 8,795,439 B2
APPLICATION NO. : 12/506879
DATED : August 5, 2014
INVENTOR(S) : Craig D. Vernon et al.

It is certified that error appears in the above-identified patent and that said Letters Patent is hereby corrected as shown below:

On the Title Page
Item (57), line 6 of the Abstract, please replace “was mat” with “construction mat”.

In the Claims
Column 9, line 15, claim 15, please replace “the filter assembly further includes” with “the filter means includes”.
Column 9, line 18, claim 15, please replace “the filter assembly” with “the filter means”.

Signed and Sealed this
Eighteenth Day of November, 2014

Michelle K. Lee

Michelle K. Lee
*Deputy Director of the United States Patent and Trademark Office*